US008937262B2

(12) United States Patent
Gentsch et al.

(10) Patent No.: US 8,937,262 B2
(45) Date of Patent: Jan. 20, 2015

(54) MEDIUM-VOLTAGE SWITCHGEAR ASSEMBLY

(75) Inventors: Dietmar Gentsch, Ratingen (DE); Maik Hyrenbach, Duisburg (DE); Harald Fink, Ratingen (DE)

(73) Assignee: ABB Technology AG, Zurich (CH)

( * ) Notice: Subject to any disclaimer, the term of this patent is extended or adjusted under 35 U.S.C. 154(b) by 1211 days.

(21) Appl. No.: 10/583,216

(22) PCT Filed: Dec. 20, 2004

(86) PCT No.: PCT/EP2004/014480

§ 371 (c)(1),
(2), (4) Date: Jun. 16, 2006

(87) PCT Pub. No.: WO2005/062328

PCT Pub. Date: Jul. 7, 2005

(65) Prior Publication Data

US 2007/0145015 A1 Jun. 28, 2007

(30) Foreign Application Priority Data

Dec. 19, 2003 (DE) ..... 103 60 633

(51) Int. Cl.

| | |
|---|---|
| ***H01H 33/666*** | (2006.01) |
| ***H01H 31/00*** | (2006.01) |
| *H01H 33/66* | (2006.01) |
| *H01H 33/662* | (2006.01) |

(52) U.S. Cl.

CPC ..... *H01H 33/666* (2013.01); *H01H 31/003* (2013.01); *H01H 33/6606* (2013.01); *H01H 33/6661* (2013.01); *H01H 2033/6623* (2013.01); *H01H 2033/6665* (2013.01)

USPC ..... 218/118; 218/10

(58) Field of Classification Search

CPC ..... H01H 31/003; H01H 33/666; H01H 33/6606; H01H 33/6661

USPC ..... 218/10, 118–121, 134, 137–140

See application file for complete search history.

(56) References Cited

U.S. PATENT DOCUMENTS

| | | | | |
|---|---|---|---|---|
| 3,812,314 | A * | 5/1974 | Nonken | 218/138 |
| 4,618,749 | A * | 10/1986 | Bohme et al. | 218/134 |
| 6,373,015 | B1 * | 4/2002 | Marchand et al. | 218/139 |
| 6,720,515 | B2 * | 4/2004 | Renz et al. | 218/136 |
| 2003/0094438 | A1 * | 5/2003 | Renz et al. | 218/136 |

* cited by examiner

*Primary Examiner* — Amy Cohen Johnson
*Assistant Examiner* — Marina Fishman
(74) *Attorney, Agent, or Firm* — Michael M. Rickin

(57) ABSTRACT

The invention relates to a medium voltage switchgear assembly which comprises at least one disconnector and whose drive unit is disposed inside or outside a gas chamber according to the generic part of claim 1. In order to further develop a switchgear assembly of the generic type so as to render the same more compact and more functional, the disconnector is embodied as a three-position vacuum chamber switch.

4 Claims, 3 Drawing Sheets

MEDIUM-VOLTAGE SWITCHGEAR ASSEMBLY

CROSS-REFERENCE TO RELATED APPLICATIONS

This application is the national phase filing of International Application No. PCT/EP2004/014480 filed on Dec. 20, 2004 published as WO 2005/062328 which designated at least one country other than the United States of America ("the PCT Application") and the PCT Application claims the priority of German Application No. 103 60 633.5 filed on Dec. 19, 2003 ("the German Application") and the contents of the PCT Application and the German Application are relied upon and incorporated herein by reference in their entirety, and the benefit of priority under 35 U.S.C. 119 is hereby claimed.

BACKGROUND

Electrical switchgear assemblies, in particular medium-voltage switchgear assemblies, contain not only a circuit breaker, which is generally permanently installed, but also a disconnector, which can assume three positions: connected position, disconnected position and grounding position; that is to say it is in the form of a three-position switch. Furthermore, the three-position switch can be provided with a load-interrupter and/or circuit-breaker function.

In the connected position, a connection is produced to the live busbar, and in the grounding position, a connection is produced to ground. In the disconnected position, the moving contact piece of the disconnector is in a mid-position between the connected position and the grounding position.

Conventional three-position disconnectors are known in the form of in-line or knife switches. It is also known that an analogous functionality can also advantageously be provided by a "three-position vacuum switching chamber".

In general, disconnectors are used as an autonomous appliance in the same gas area as the load-interrupter switch or circuit breaker, or in a separate gas area, particularly in the case of double busbar arrangements. The electrical part of these appliances is always a component of the gas area, and is connected by means of a gas-tight bushing to the drive, which is located inside and outside the gas area, and in medium-voltage applications, is normally in the form of a mechanical or magnetic drive.

As an autonomous appliance, a disconnector—if arranged in the same area as the load-interrupter switch or circuit breaker—requires a correspondingly large enclosure, or requires its own gas area if arranged separately. The latter in turn means additional passages between the different gas areas.

In both cases, additional complexity is required for material, assembly and testing. The dimensions of the switchgear assembly are correspondingly large, and this is disadvantageous.

SUMMARY OF THE INVENTION

The invention is thus based on the object of developing a switchgear assembly of this generic type in such a way that it is more compact and more functional.

The essence of the invention is in this case that the switch disconnector is in the form of a three-position vacuum-chamber switch.

A further advantageous refinement specifies that the three-position vacuum switching chamber is designed such that it forms and replaces the bushing which leads from inside said gas area to outside the gas area, and forms a direct connection to the busbar.

The gas area may be in the form of a gas-insulated or solid-insulated busbar for three phases or else for one phase. Instead of a gas area, one half as well as the device can also be encapsulated in a further solid on both sides.

In another advantageous refinement, the three-position vacuum switching chamber is designed such that it is integrated in an annular seal which leads from inside said gas area to outside the gas area.

It is also advantageous for the three-position vacuum switching chamber to be integrated in a cast-resin bushing, that is to say can be provided with a cast-resin body.

In this case, the three-position vacuum switching chamber can be designed such that, with its ceramics, it itself forms the bushing.

Furthermore, in one advantageous refinement, the three-position switch is designed such that, in addition to the disconnection function, it can also carry out the functions of load switching and power switching.

In a final advantageous refinement, the described requirements for the disconnector bushings can be used both for a single and a double busbar application.

For compact medium-voltage switchgear assemblies with a high level of function integration, it appears to be advantageous to integrate the disconnector—in the form of a three-position vacuum switching chamber—directly in function-relevant parts, such as a cast-resin bushing, or to design the three-position vacuum switching chamber such that it (with its ceramics) itself forms the bushing. In the first-mentioned case, the encapsulation technology is well known in particular from vacuum switching chambers, and is prior art.

The object of the bushing is normally to connect the live current paths in different gas areas and to isolate them from the grounded encapsulation. At the same time, the bushing can provide mechanical stability between different enclosures, and can also maintain their separation.

The load-interrupter switch or circuit breaker is connected to one side 8 of the three-position disconnector. This side represents the feeder to the moving contact mount in the three-position vacuum switching chamber. As an electrical part of the disconnector, the vacuum switching chamber can be completely encapsulated in cast-resin 12, with the cast-resin body being in the form of a bushing.

If the mechanical part of the disconnector (drive) is located outside the gas area, it is normally connected to the vacuum switching chamber via a gas-tight bushing and a linkage.

The other side 11 of the three-position vacuum switching chamber, the feeder to the fixed contact mount in the vacuum switching chamber, forms the direct connection to the busbar. This connection can be formed under an insulating gas. A physically small gas area is then required in order to accommodate this connection and to continue the busbar to the gas area of the next switchgear panel or block (busbars joined together across a plurality of panel junctions). This gas area may be in the form of a traditional busbar area for three phases, or in the form of a gas-insulated busbar for one phase.

A block in turn comprises a plurality of switchgear panels with a common gas area. There are no moving parts whatsoever in this gas area. In addition, no switching operations are carried out in this gas area.

Furthermore, the connection of the three-position vacuum switching chamber to a rail with solid insulation may be in a plug-in form or may even, for example, be encapsulated in a solid once again, on one side or else on both sides. In this case, the bushing is designed to be protected against direct contact on the side associated with the busbar, that is to say it is provided with a conductive coating. The busbar may be connected via a plug-in contact, which is part of the bushing.

The bushing with the three-position vacuum switching chamber (DSK) is itself designed such that the connection to the busbar is made when the vacuum switching chamber is in the connected state. When the vacuum switching chamber is in the "disconnected position", that is to say also the mid-position between the connected position and the grounding position, different potentials can be isolated. This arrangement has a disconnection-path/isolation capability.

BRIEF DESCRIPTION OF THE DRAWINGS

The invention will be described in more detail in the following text and is illustrated in the drawing, in which.

DETAILED DESCRIPTION OF THE INVENTION

Figure 1:
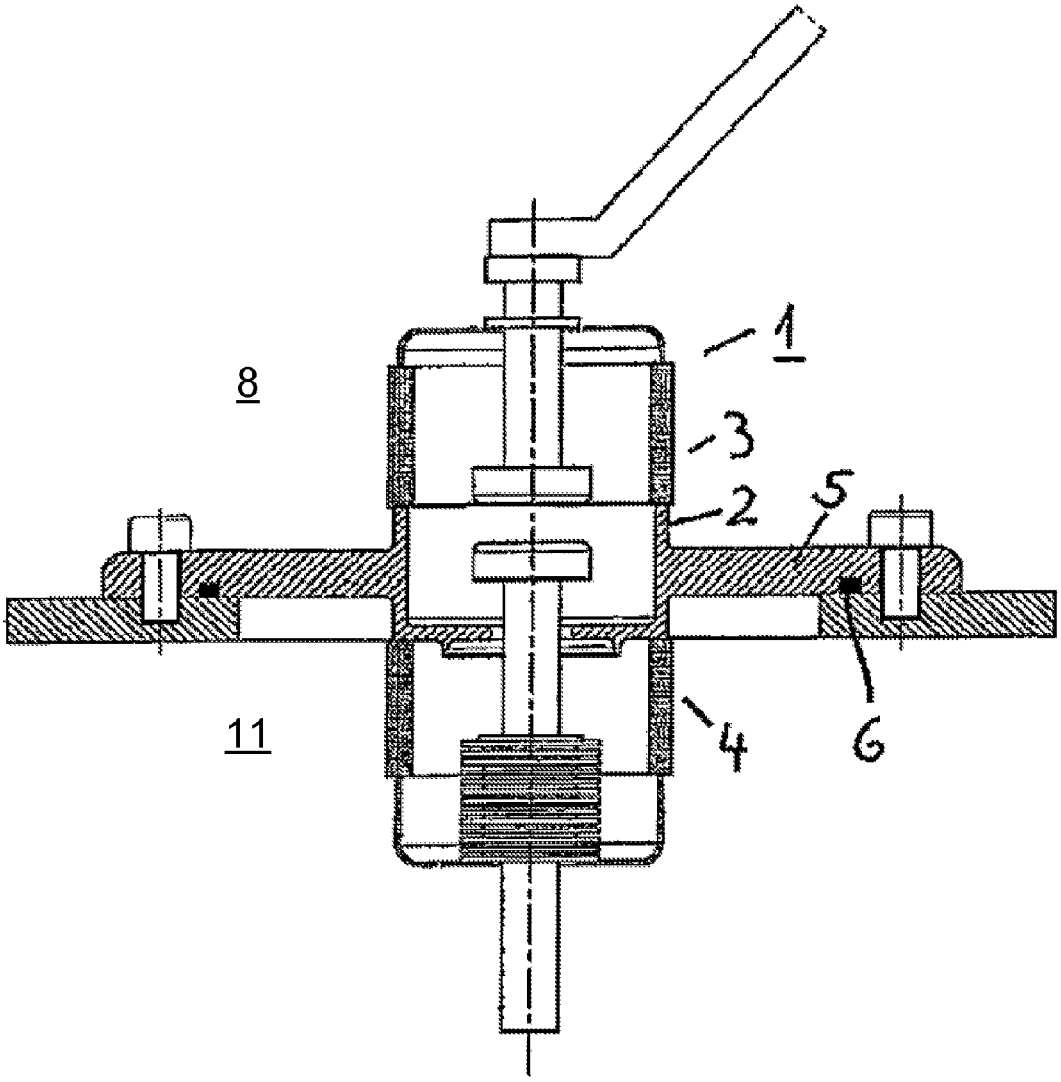
FIG. 1: shows a switch disconnector according to the invention.

The grounding position requires a connection, integrated in the bushing, from a "ground point" to the metallic center part 2 of the vacuum switching chamber 1, which is located between the isolating ceramics 3, 4 shown in FIG. 1.

Figure 2:
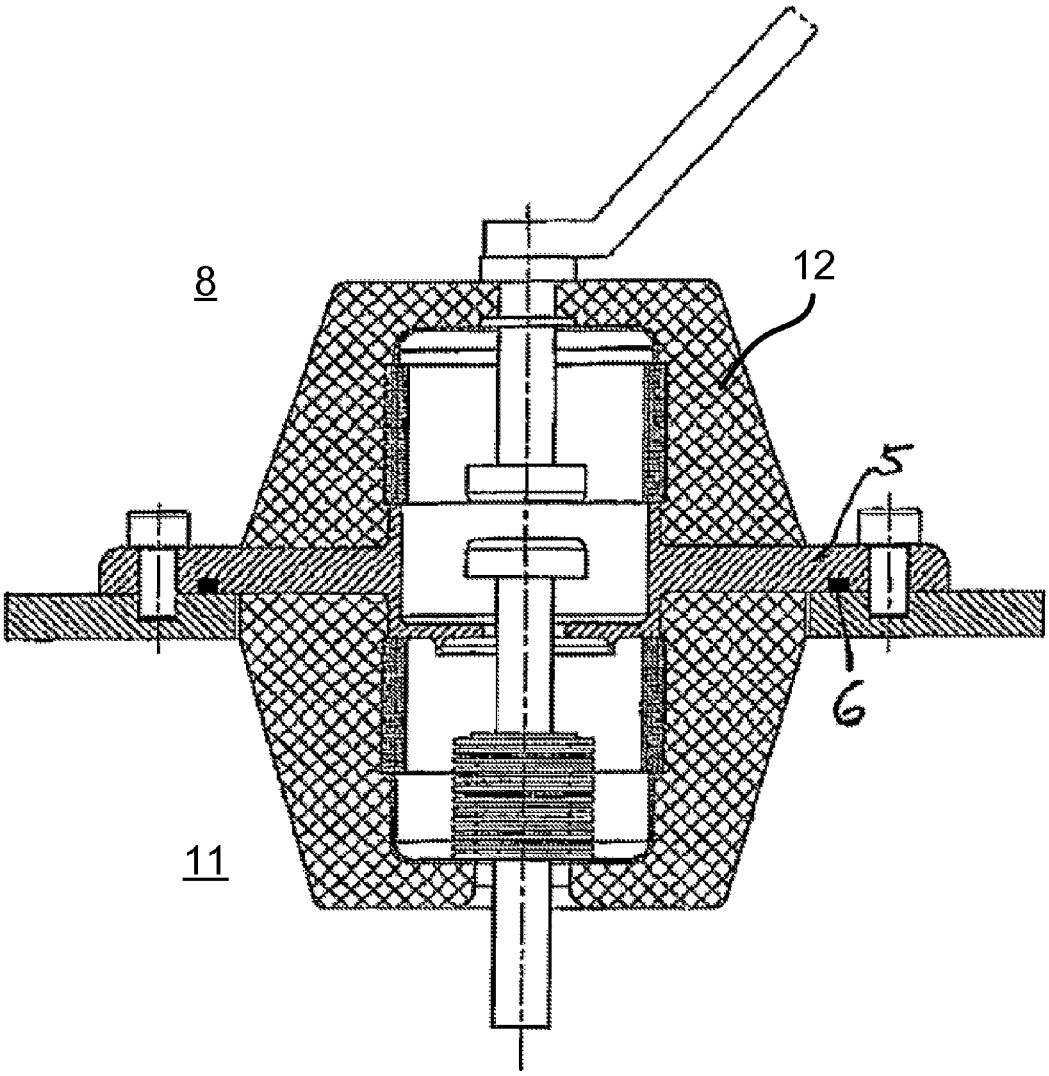
FIG. 2: shows a switch disconnector according to the invention with direct function of a bushing.

In the situation shown in FIG. 1, in the same way as in the situation shown in FIG. 2, in which the three-position vacuum switching chamber is itself used directly as the bushing, an edge board 5 is fitted to the metallic center part 2 of the three-position vacuum switching chamber, and allows the connection to the "ground point". The edge board 5 can also be equipped with a seal 6, which provides the seal to the gas area.

This can most expediently be achieved by the electrical ground connection forming a unit with the mechanical connection, so that the ground connection is ensured by the fitting of the bushing.

The described arrangement of the disconnector bushing can be used both for single-busbar and for double-busbar applications.

The three-position vacuum switching chamber in the form of a bushing disconnector can be designed as follows, based on even greater function integration.

Figure 3:
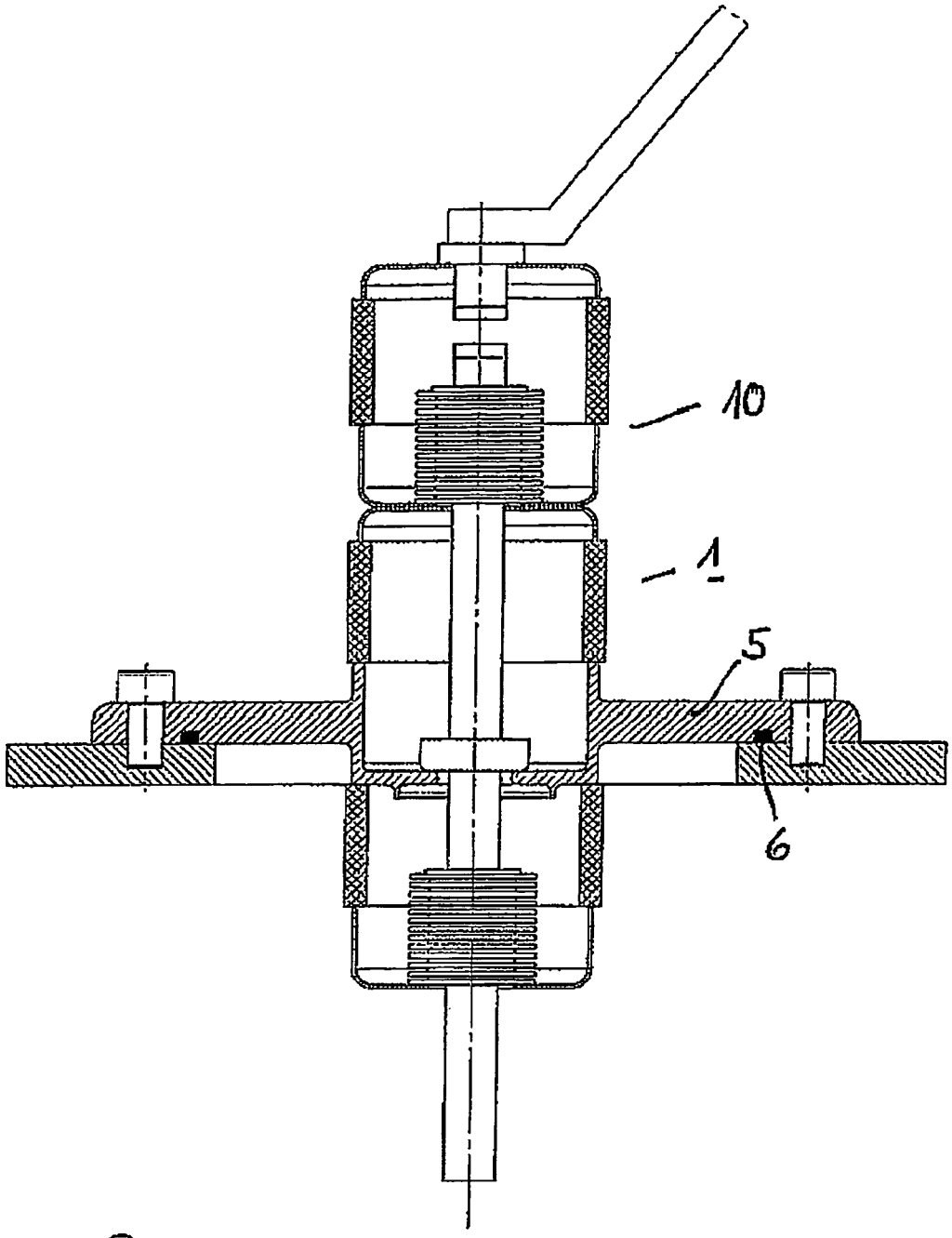
FIG. 3: shows a bushing switch disconnector with a load-interrupter and circuit-breaker capability.

FIG. 3 shows a corresponding bushing switch disconnector with, in addition to the functions of a connected position, disconnected position and grounding position, can also carry out the function of load switching and power switching, that is to say it additionally has a load switching and power switching capability.

For this purpose, a vacuum switching chamber is used which, as illustrated in FIG. 3, has a second area 10 or at least one shielded area within a vacuum switching chamber, which can also be arranged separately on the vacuum switching chamber, in which this switching path is located.

This makes it possible to ensure that, in practice, no plasma can pass from this switching path into the area of the grounding path during the disconnection of load currents or short-circuit currents.

This reduces vaporization of the isolation paths, or prevents it entirely when using a separate area, thus providing safe isolation in the mid-position. This is achieved by disconnection of both paths by means of a bellows or by means of a labyrinth composed of interleaved shielding components.

A contact system can be located in the load-interrupter switching area, formed from blade contacts. The features of a circuit-breaker vacuum switching chamber are required for a short-circuit-current disconnection capability. Both RMF and AMF contact systems may be used for this purpose.

RMF is short for radial magnetic field, and AMF for axial magnetic field.

In contrast to three-position vacuum switching chambers without a disconnection capability, this switching chamber with a disconnection capability requires a drive which quickly separates the switching contact pieces in a known manner, at least during disconnection of them, at least as far as the region of the disconnected position (mid-position).

The invention claimed is:

1. A medium-voltage switchgear assembly comprising:

an enclosure filled with an insulating gas; and a bushing extending through the enclosure such that an interior portion of the bushing is disposed inside the enclosure with the insulating gas and an exterior portion of the bushing is disposed outside the enclosure, the bushing comprising a vacuum switching chamber and a conductive edge board connected to and extending radially outward from the switching chamber, the edge board being connected to a wall of the enclosure and having a seal that engages an outer surface of the wall to form a gas tight seal therewith, the connection of the edge board to the wall forming a ground point for the switching chamber.

2. The medium-voltage switchgear assembly of claim 1, wherein the bushing has a cast-resin body that encapsulates the switching chamber.

3. The medium-voltage switchgear assembly of claim 2, wherein the switching chamber comprises a three-position switch enclosed in a vacuum insulated housing having a metal center portion disposed between ceramic end portions, the center portion being connected to the edge board.

4. The medium-voltage switchgear assembly of claim 3, wherein the switch comprises a moving contact and a fixed contact, the fixed contact being disposed in the interior portion of the bushing.

* * * * *